US005078039A

United States Patent [19]

Tulk et al.

[11] Patent Number: 5,078,039

[45] Date of Patent: Jan. 7, 1992

[54] MICROPROCESSOR CONTROLLED LAMP FLASHING SYSTEM WITH COOLDOWN PROTECTION

[75] Inventors: Steven E. Tulk; Richard S. Belliveau, both of Austin, Tex.

[73] Assignee: Lightwave Research, Austin, Tex.

[21] Appl. No.: 564,180

[22] Filed: Aug. 8, 1990

Related U.S. Application Data

[63] Continuation-in-part of Ser. No. 240,538, Sep. 6, 1988, Pat. No. 4,962,687.

[51] Int. Cl.[5] ..... A63J 17/00

[52] U.S. Cl. ..... 84/464 R; 362/85

[58] Field of Search ..... 84/464 R; 362/85, 218, 362/227, 233, 276, 294, 345, 373

[56] References Cited

U.S. PATENT DOCUMENTS 2,909,097 10/1959 Alden et al. .
3,318,185 5/1967 Kott .
3,543,087 11/1970 Saiger .
3,818,216 6/1974 Larraburu .
4,262,338 4/1981 Gaudio, Jr. .
4,392,187 5/1983 Bornhorst .
4,622,881 11/1986 Rand .
4,635,052 1/1987 Aoike et al. .
4,701,833 10/1987 Bornhorst ..... 362/294
4,962,687 10/1990 Belliveau et al. ..... 84/464 R

FOREIGN PATENT DOCUMENTS 86265261 4/1987 Fed. Rep. of Germany .

*Primary Examiner*—Steven L. Stephan
*Assistant Examiner*—Emanuel Todd Voeltz
*Attorney, Agent, or Firm*—Sixbey, Friedman, Leedom & Ferguson

[57] ABSTRACT

The microprocessor controlled lamp flashing system includes a plurality of flash lamp assemblies for providing lighting effects in response to input control signals from a central processor. The control signals are provided in a data packet with intensity and address signals, and each flash lamp assembly includes a microprocessor which controls a flash control circuit for a flash lamp. Each microprocessor is connected to a preset address circuit which causes the microprocessor to respond to a unique address signal in the data packet and register the intensity signal associated with the unique address signal. The microprocessor controls cooldown of the flash lamp by registering intensity values and deactivating the flash control circuit for a determined cooldown time when the intensity values registered in a time period exceed a predetermined threshold value.

17 Claims, 5 Drawing Sheets

MICROPROCESSOR CONTROLLED LAMP FLASHING SYSTEM WITH COOLDOWN PROTECTION

The present application is a continuation in part application of U.S. Ser. No. 240,538 filed Sept. 6, 1988, now U.S. Pat. No. 4,962,687 and incorporates the disclosure thereof herein by reference.

The present invention incorporates a microfiche appendix with one microfiche having 168 frames.

TECHNICAL FIELD

The present invention relates generally to controlled lamp flashing systems, and more particularly to a processor controlled lamp flashing system which permits a plurality of flash lamp devices to be operated in a periodic and controlled manner from a single controller.

BACKGROUND OF THE INVENTION

In the past, a number of control circuits have been developed to operate gas filled flash lamps in a periodic and controlled manner. With such circuits, flash lamps are caused to provide light in response to an electrical discharge through the lamp produced upon receipt of a control signal from a flash control unit. One effective prior art circuit is illustrated by U.S. Pat. No. 3,543,087 to G. P. Saiger et al. which discloses a circuit for controlling electric discharges through a flash lamp at a preselected rate and preselected phase with respect to an input from an alternating voltage source. The circuit includes a phase control system which provides half-wave phase control for determining the preselected phase relation of electrical discharges through a flash lamp, as well as flash rate control which provides a firing or trigger signal to the flash lamp to effect electrical discharge.

The Saiger et al. patent illustrates a single control circuit for a single flash lamp, and although such devices have found utility in various fields of use for a multitude of purposes, there has recently arisen a great demand for systems including a large number of lamps which are controlled from a single controller. Multiple lamp systems are particularly desirable for stage lighting, and for producing various types of theatrical effects, and consequently the ability to control both the phase and timing of a large number of flash lamps from a single controller would be most desirable.

Relatively sophisticated optical systems have been developed to provide an infinite variety of lighting effects with multiple lamps of various types under the control of a central processor. Examples of such prior multiple lamp systems are illustrated by U.S. Pat. No. 4,262,338 to J. J. Gaudio, Jr., Pat. No. 4,392,187 to J. M. Bornhorst, and Pat. No. 4,635,052 to N. Aoike et al. As will be noted from these patents, the prior multiple lamp display systems disclosed normally include a relatively complex central controller which processes control signals to fire selected ones of a plurality of remote lamps. For example, the Aoike et al. patent shows a central controller which provides signals determinative of both the duty cycle and intensity of remote lamps, and the remote lamp circuit primarily contains only a discharge lamp and a high frequency generator, such as a generator including two thyristor inverters.

In the display system illustrated by the Gaudio, Jr. patent, lamp timing sychronization is determined by a central processor unit which generates interrupts at one or a plurality of intervals throughout each half cycle of an external power wave form. To achieve such interrupts, a conventional zero crossing detector detects the beginning of each period or half cycle of external power and resets counters with each zero crossing of a rectified half cycle of the input power signal. Here again, all control of multiple lamps is achieved from a complex central processor.

With multiple lamp systems, heat becomes a problem if an individual lamp is repetitively energized over a short period of time from a central controller. In an attempt to alleviate this heat problem, multiple lamp systems are generally supplied with cooling fans, as illustrated b the Bornhorst patent.

DISCLOSURE OF THE INVENTION

It is a primary object of the present invention to provide a novel and improved microprocessor controlled lamp flashing system wherein a plurality of flash lamp units operate in response to serial data transmitted from a central controller.

Another object of the present invention is to provide a novel and improved microprocessor controlled lamp flashing system wherein a multiplicity of remote lamp fixtures operate in response to simple serial data transmitted from a central controller. This serial data basically provides address, intensity and time base information to each flash lamp, and each flash lamp fixture includes programmable address circuitry and a control microprocessor which responds to the serial data signals from the central controller.

Yet another object of the present invention is to provide a novel and improved microprocessor controlled lamp flashing system wherein remote flash lamp fixtures in the system include a microprocessor controller. This microprocessor controller operates to control the heat generated by the associated flash lamp fixture by storing heat value data dependent upon the intensity of each flash lamp strobe signal and by determining in response to a time reference signal whether or not a heat threshold has been exceeded. If the heat threshold is exceeded, the microprocessor will shut down the flash lamp for a predetermined cooldown period, thereby eliminating the necessity for a fan installation for each flash lamp.

A still further object of the present invention is to provide a novel and improved microprocessor controlled lamp flashing system wherein a plurality of flash lamps can be strobed to achieve different intensity levels simultaneously. Each flash lamp is individually addressable, and contains a microprocessor and a logic system to provide full wave phase control.

DESCRIPTION OF THE PREFERRED EMBODIMENTS

Figure 1:
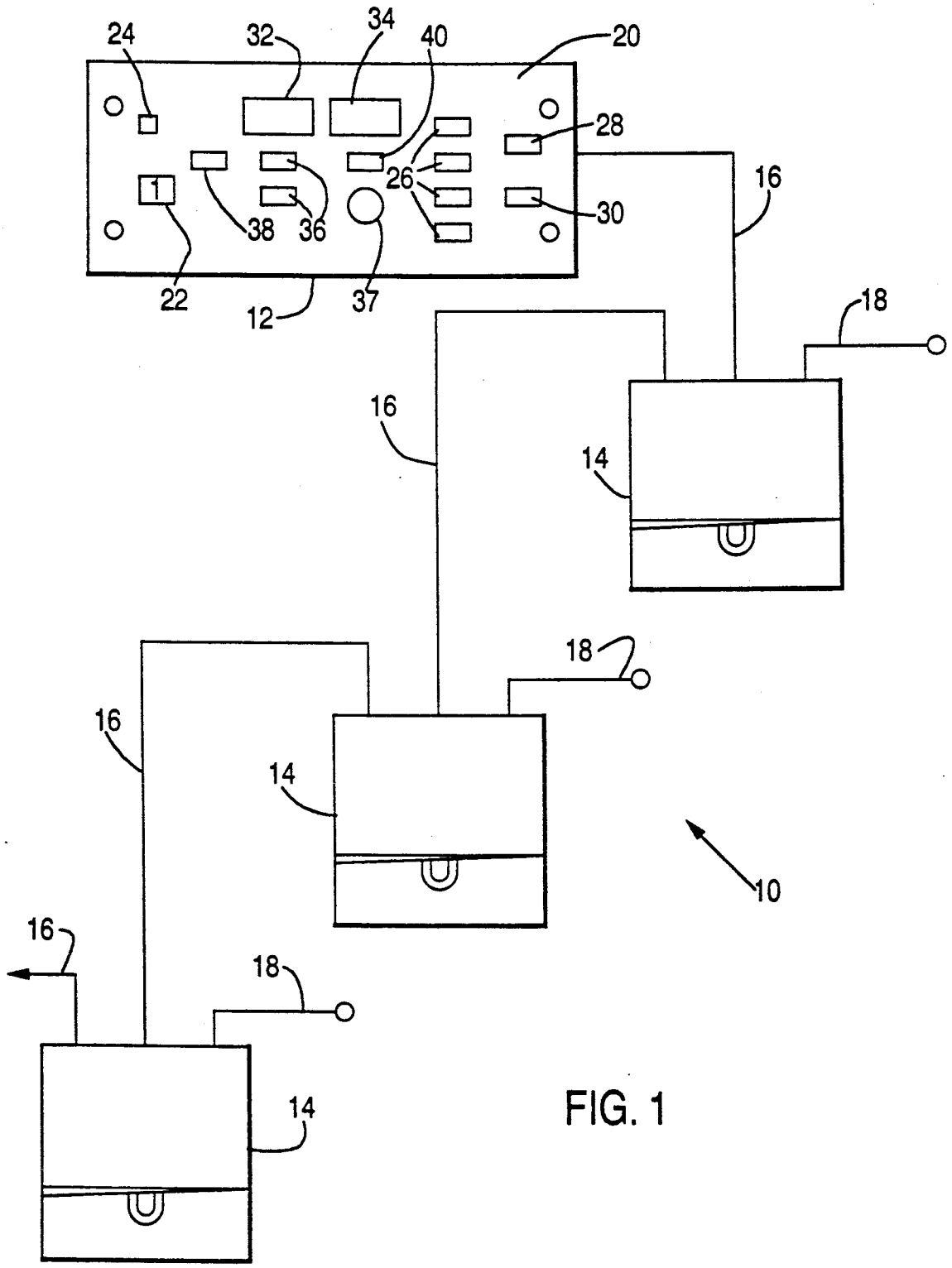
FIG. 1 is a block diagram of the microprocessor controlled flashing system of the present invention.

Referring now to the drawings, the microprocessor controlled lamp flashing system of the present invention indicated generally at 10 in FIG. 1 includes a central controller 12 which provides control signals to a plurality of flash lamp assemblies 14 over a serial data link 16. This data link is capable of transmitting serial data at 375K baud, and this permits up to 256 flash lamp assemblies to be individually addressed within six milliseconds. As will be noted in FIG. 1, the flash lamp assemblies 14, three of which are shown, are serially connected by the data link 16, and each flash lamp assembly is connected to an AC power line by an AC input 18. Each flash lamp assembly includes a housing 19 which houses a lamp control circuit.

The central controller 12 includes a control panel 20 which provides control buttons and indicators for the system. Thus, the control panel includes a power control switch 22 which is activated to provide power to the unit, and situated above the power control switch is a stand-by switch 24 which selectively activates or disables the output of the central controller over the serial data link 16. Normally, the lamp intensity and address data to be transmitted over the serial data link is preprogrammed in one of four memories which may be selected by switches 26. Each preprogrammed memory constitutes a group of pages wherein each page provides a scene and contains stored information concerning lamp identification addresses and intensities. An enable switch 28 initiates the preprogrammed memory operation while an advance switch 30 may be operated to manually control page advance from a selected memory.

The control panel 20 includes several display indicators, such as those indicated at 32 and 34, which display memory information, intensity information, and memory page information. The programmed pages or scenes may be displayed by manually operating one of two sequence control switches 36, whereby depression of the top switch advances the stored sequence while depression of the bottom switch reverses the sequence. The programmed intensity of various lamps may be manually altered by rotating a manual intensity control knob 37.

In some cases, it is desirable to modulate light intensity to an audio input to the central controller 12, rather than in response to prerecorded intensity information in memory. To accomplish this, a modulate switch 38 is activated and the intensity control for the flash lamp assemblies programmed on a memory page changes from the preprogrammed intensities to audio filter control. The modulate control system samples an audio input that has been filtered into different frequencies, and intensity control is no longer provided by the preprogrammed memory, but is instead provided by a built-in random generator responsive to the filtered frequencies.

Finally, a send switch 40 on the control panel causes control data to be sent over the serial data link 16. The control data transmitted includes a data packet including an arm byte, a start byte, information bytes including intensity and address information, and a time base (heartbeat) reference. Since only this relatively simple serial data control signal is required for the microprocessor controlled lamp flashing system 10, the central controller 12 is not the complex, sophisticated central controller which has been commonly employed in previously known multiple lamp display systems. In previous systems, it has been necessary to utilize complex central processors in the central controller which provide control information over multiple data links to somewhat conventional remote lamp assemblies. Unlike these systems, the microprocessor controlled lamp flashing system 10 includes microprocessors in each of the individual flash lamp assemblies 14, and therefore these assemblies require only time base, intensity, and address information which can be easily sent over a serial data link.

Figure 2:
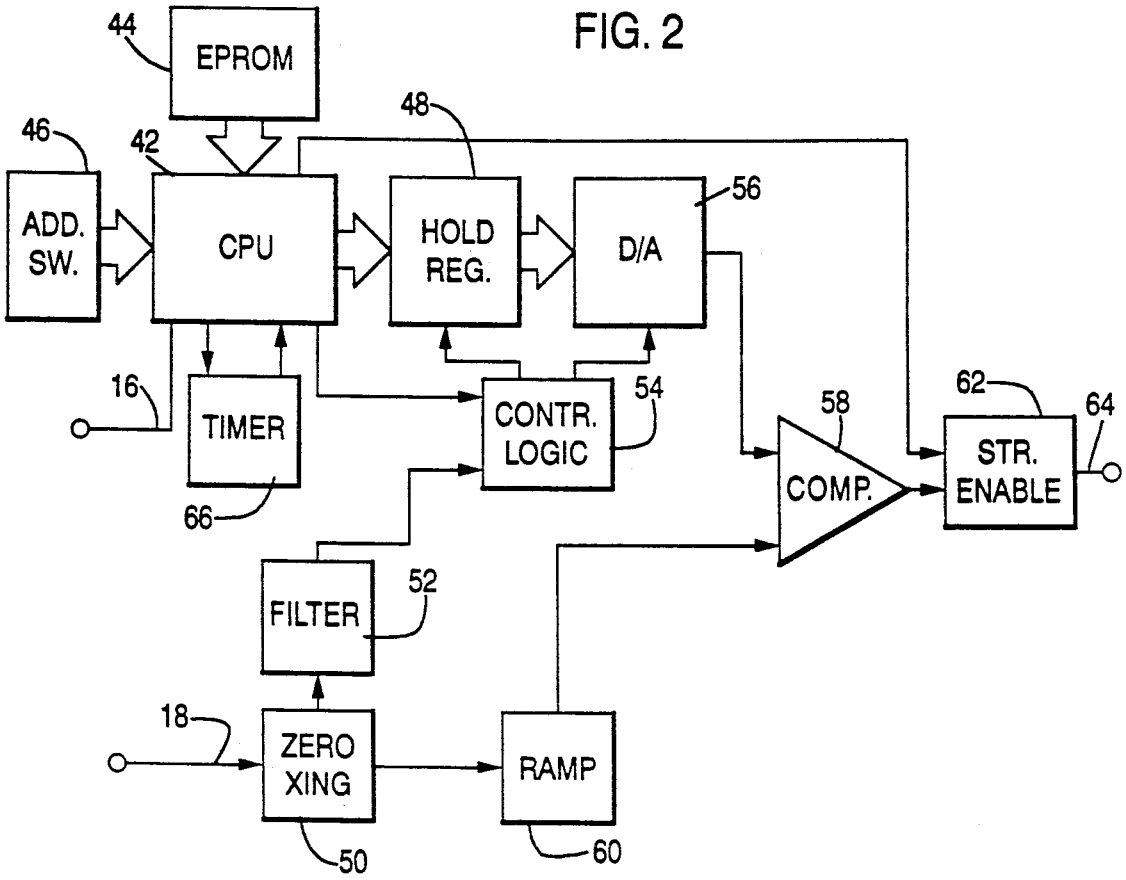
FIG. 2 is a block diagram of the microprocessor controlled strobe circuit for each flash lamp in the system of FIG. 1.
Figure 3:
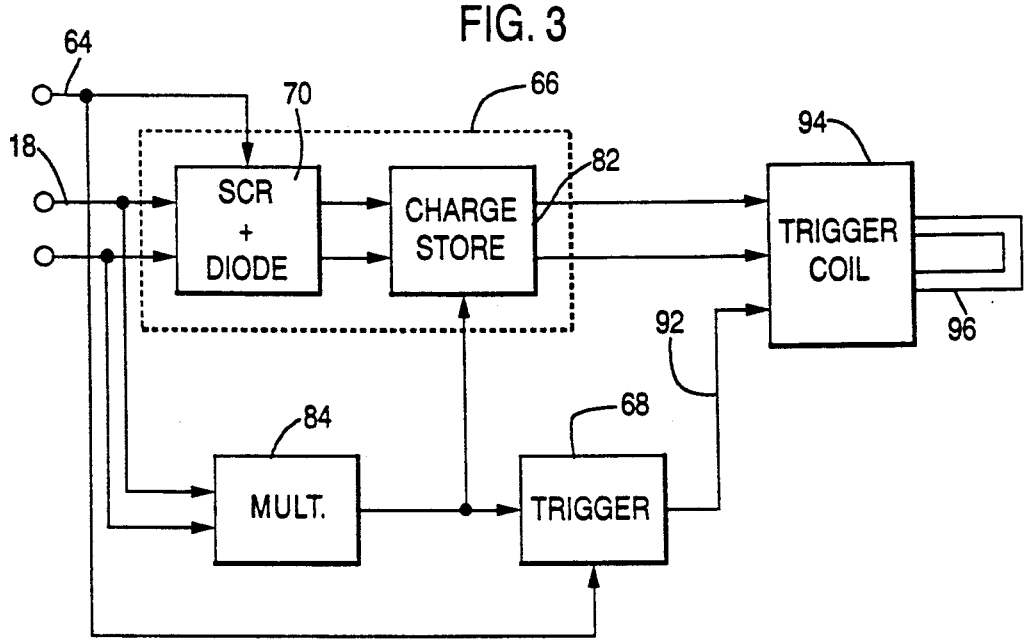
FIG. 3 is a block diagram of the flash lamp firing circuit for each of the flash lamps in the system of FIG. 1.

Referring now to FIGS. 2 and 3, the lamp control circuitry present in each flash lamp assembly 14 is illustrated. Data on the serial data link 16 is fed to a microprocessor 42 which checks the address information to determine if the flash lamp controlled by the microprocessor is to be activated. Each flash lamp assembly has a unique address which is preset by eight channel dip switches 46. If the data packet on the data link 16 contains the proper address, then the microprocessor 42 takes a digital intensity signal from the data packet and places it in a holding register 48.

The AC signal from the input 18 is provided to a zero crossing detector 50 which senses the zero crossings of the input AC signal and provides synchronization for phase control. The output from the zero crossing detector at each zero crossing point is provided through a noise filter 52 to one input of a control logic gate assembly 54. When the control logic gate assembly receives an input from both the zero crossing detector and the microprocessor 42 indicating that intensity data for the flash lamp assembly has been received, the control logic gate assembly will provide an output activate signal to both the hold register 48 and a digital to analog converter 56. Upon activation, the hold register provides a digital signal indicative of the intensity value received by the microprocessor 42 to the digital to analog converter 56, which then provides an analog output indicative of intensity to a comparator 58.

The zero crossing detector 50 not only provides an output signal at each zero crossing of the input AC signal on the line 18 to the control logic gate assembly 54, but also provides an output at each zero crossing to a ramp generator 60. This ramp generator produces a saw-toothed ramp wave form which is synchronous to the AC signal on line 18, and this output ramp is provided to an input of the comparator 58 for comparison with the analog intensity signal.

The central controller 12 is capable of providing digital signals in the data packet over the serial data link 16 which are indicative of one of 16 possible intensity levels, and the amplitude of the analog signal provided by the digital to analog converter 56 will be dependent upon the specific intensity level indicated by the digital signal received from the register 48. When the ramp from the ramp generator 60 reaches the amplitude level of the analog signal from the digital to analog converter 56, the comparator 58 will provide an output signal to a strobe enable circuit 62. This strobe enable circuit is an AND gate having an input connected to the microprocessor 42, so that once an activate signal is received from the microprocessor plus an output signal from the comparator 58, a strobe signal is provided on a strobe output 64.

The microprocessor 42 is connected to a watch dog timer 66 which operates in a conventional manner to insure proper operation of the microprocessor. The watch dog timer receives strobe pulses from the microprocessor, and in the absence of such pulses for a predetermined period, operates to automatically reset the microprocessor.

Figure 4:
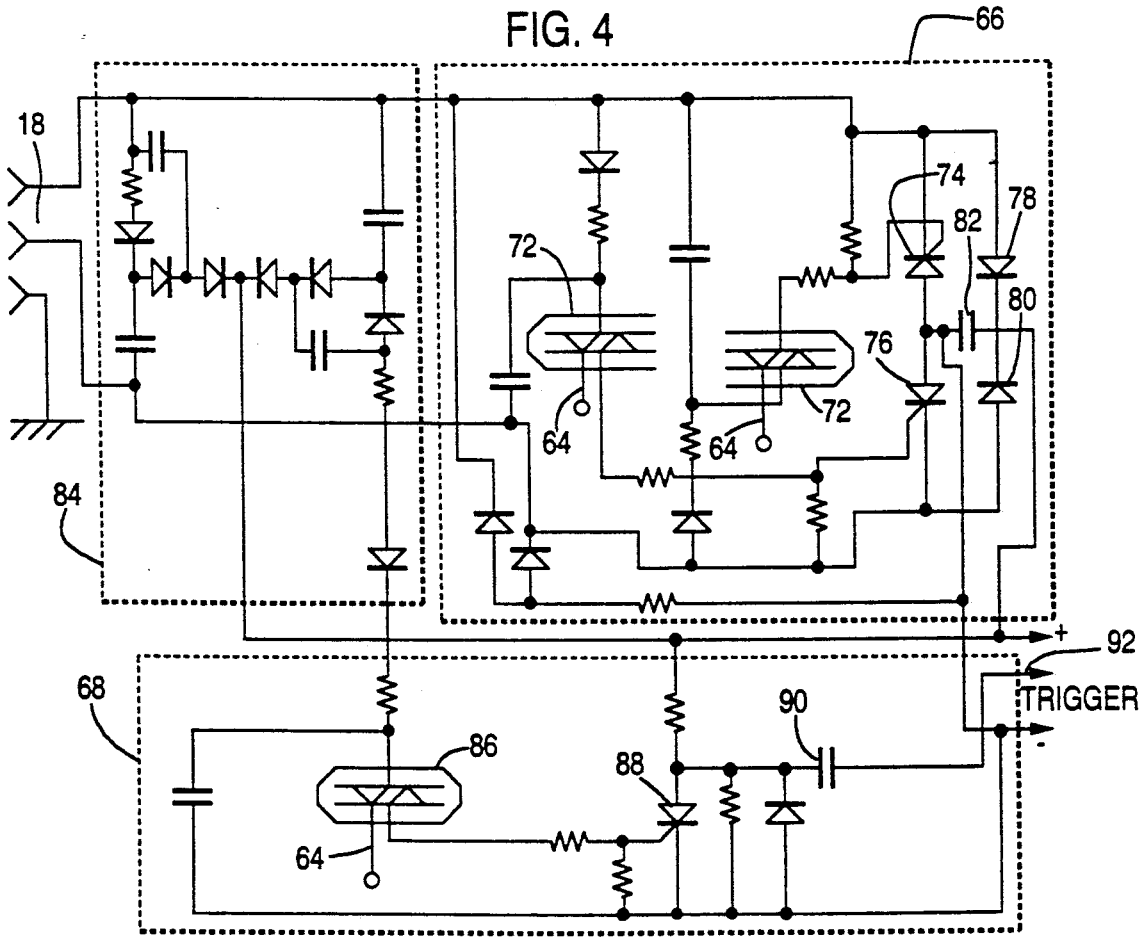
FIG. 4 is a circuit diagram of the firing circuit of FIG. 3.

Referring now to FIGS. 3 and 4, the strobe signal on the strobe output 64 is provided to a phase control circuit 66 and to a trigger circuit 68. An SCR and diode bridge 70 provides phase control of the top and bottom cycles of the AC input present on line 18 which is directed to the phase control circuit 66. As will be noted in FIG. 4, the strobe signal is provided to the phase control circuit by a driver 72 which selectively activates either an SCR 74 or an SCR 76. The SCRs 74 and 76 provide a bridge with diodes 78 and 80, and conduction of either the SCR 74 or the SCR 76 controls the discharge of a charge storage capacitor 82 which has been charged by a multiplier circuit 84.

The AC input on the line 18 is provided to the multiplier circuit 84 which is connected across the AC line. This circuit operates in known manner to provide rectified voltage pulses from the AC waveform to both the charge storage capacitor 82 and the trigger circuit 68. As will be noted in FIG. 4, the strobe signal on the output 64 is provided to a driver 86 in the trigger circuit 68 and controls the conduction of a SCR 88 and thereby the discharge of a trigger capacitor 90 on a trigger output 92. The operation of the charge storage capacitor 82 and the trigger capacitor 90 control the charge on a trigger coil 94 to energize a trigger electrode for a flash lamp 96 in one of the flash lamp assemblies 14.

Figure 5:
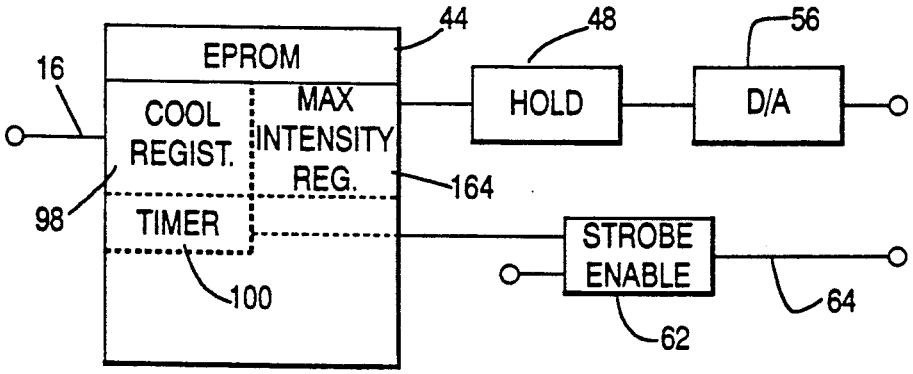
FIG. 5 is a block diagram of the microprocessor cooldown circuit of FIG. 2.

Referring to FIG. 5, the microprocessor 42 operates in response to a program in the memory 44 to effectively control the heat generated by the flash lamp 96, thereby eliminating the need for a cooling fan circuit in each of the flash lamp assemblies 14. Stored in the memory 44 is a heat value for each of the sixteen flash lamp intensities which might be incorporated in the data packet transmitted to the microprocessor 42 over the serial data link 16. Each time a specific flash lamp assembly is addressed, the microprocessor senses the intensity data in the data packet received, and increments a cooldown register 98 with a heat value corresponding to the sensed intensity value. The cooldown register is constantly decremented by the time base reference pulses transmitted on the data link 16, so that the register will never reach a cooldown threshold value if there is a sufficient delay between successive activations of the flash lamp 96. On the other hand, if the flash lamp is activated a number of times in close succession, the increments added to the cooldown register 98 will continuously increase the register value in spite of the reduction provided by the timing pulses until the cooldown threshold value is reached. At this point, the microprocessor 42 will deactivate the flash lamp 96 for a preset programmed time indicated by a timer 100. The microprocessor may operate in any known manner to shut down the flash lamp 96 during the cooldown period, and one effective way of achieving the shut down is to withhold the activating signal from the strobe enable circuit 62 during the cooldown period. At the end of the cooldown period, the strobe enable circuit can again be activated by the microprocessor 42, and the cooldown register 98 is again incremented in accordance with heat values and decremented by the timing signal from the data packet.

Figure 6:
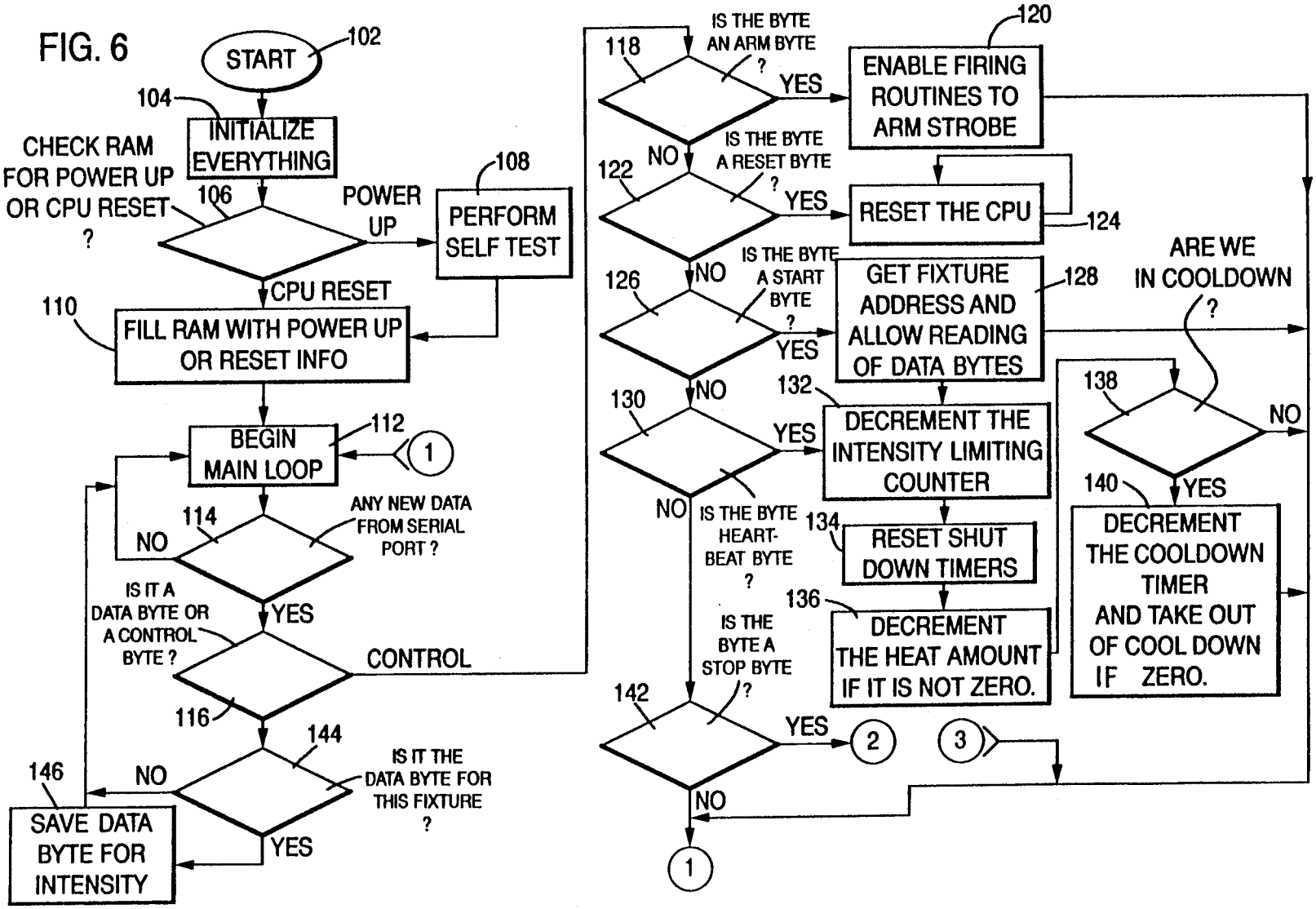
FIG. 6 is a flow diagram of the basic preparatory control functions for the microprocessor of FIG. 2.
Figure 7:
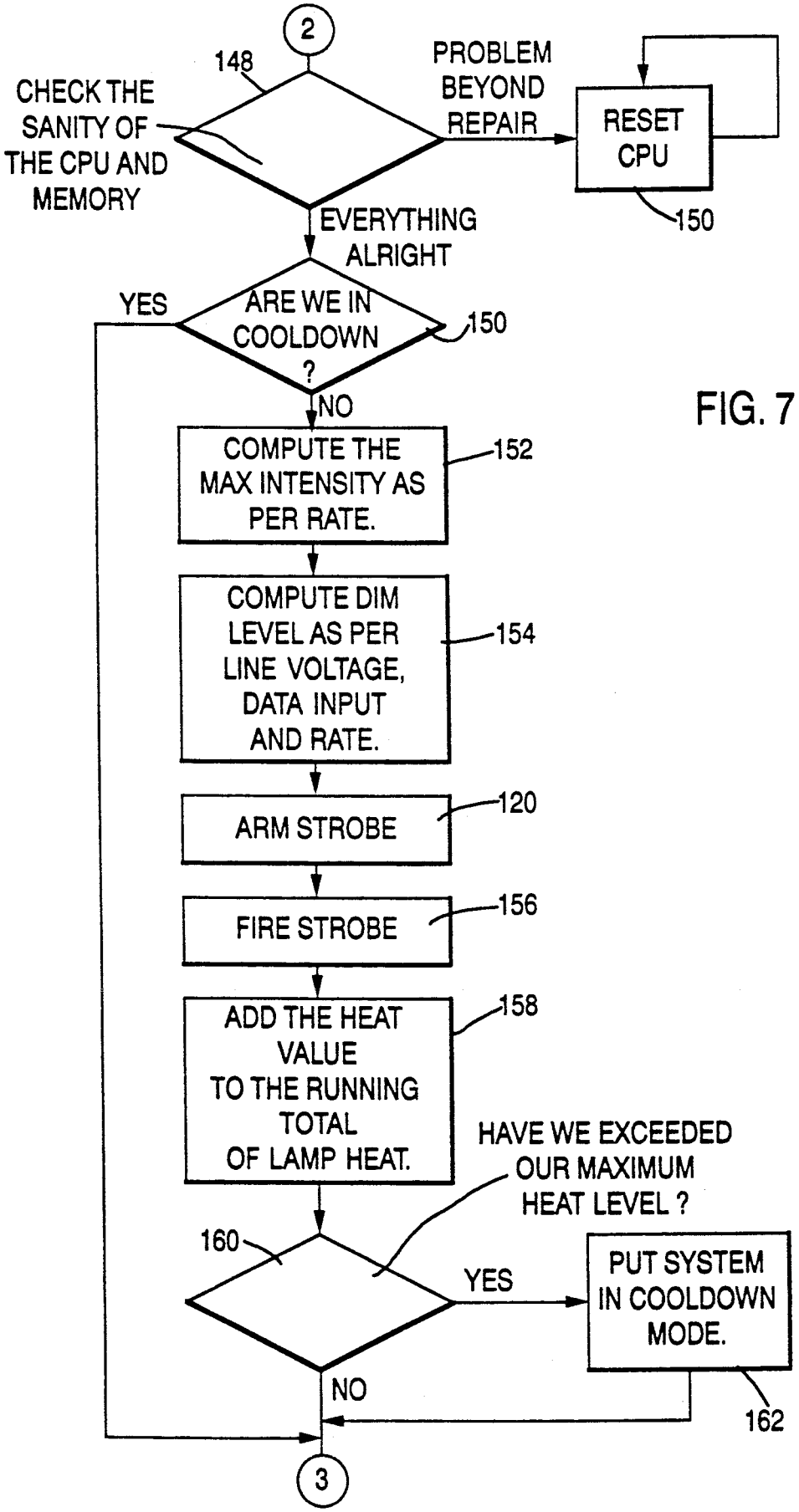
FIG. 7 is a flow diagram of the strobe control function performed by the microprocessor of FIG. 2.

The operation of the microprocessor 42 will best be understood by the reference to the flow diagrams of FIGS. 6–7 taken in combination with the program of the appendix. When the microprocessor controlled lamp flashing system 10 is activated, the microprocessor control loop is started at 102 and initialize step 104 is initiated. This results in the various components of the flash lamp assembly 14 being brought into an operating mode, and at 106 a check is made for memory power up and to ensure that the microprocessor is reset. If the memory power up check is positive, a number of self-tests are performed at 108 and the memory is then filled with power up information at 110. If, on the other hand, the microprocessor reset check is positive, the memory is filled with reset information directly at 110.

Once the initialize process has been completed, the main control loop operation is begun at 112. With the main control loop operation, a check is made at 114 to determine if any new data is present on the serial data link 16. If a data packet is present, then a check is made at 116 to determine whether the sensed data is a control byte or a data byte. Each data packet includes an arm byte, a start byte, a plurality of timing or heartbeat bytes, and a stop byte, all of which constitute control bytes. In addition, the data packet includes data bytes which incorporate address and intensity information for selected flash lamp assemblies. Each byte of a data packet is sent in sequence over the serial data link 16 to all flash lamp assemblies, and once the arm byte and stop byte have been received, the next bytes in the data packet control selected flash lamp assemblies. For example, the next data byte in a packet might include address and intensity information for flash lamp assemblies 1 and 2, with the next succeeding byte including address and intensity information for flash lamp assemblies 3 and 4, and so forth through all 256 flash lamp assemblies.

If, at 116, a control byte is sensed, then at 118 it is determined whether or not this control byte is an arm byte, and if an arm byte is sensed, then various firing routines to arm the strobe circuits for the selected flash lamp assembly are initiated at 120 and the routine returns to the main loop.

If, at 118, an arm byte is not sensed, then at 122 a determination is made as to whether or not the control byte is a reset byte, and if so, the microprocessor 42 is reset at 124. On the other hand, if a reset byte is not sensed at 122, then at 126 a determination is made as to whether or not the byte is a start byte. In response to the start byte, the fixture address is checked at 128, and if the proper address is sensed, the program permits reading of the data bytes in the received data packet. Again, after this is accomplished at 128, the system returns to the main control loop.

If the byte sensed at 126 is not a start byte, then a determination is made at 130 as to whether or not the sensed byte is a heartbeat or timing byte. If a timing byte is sensed, an intensity limiting counter in the microprocessor is decremented at 132, shutdown timers, such as the shutdown timer 100 are reset, and the heat value in the register 98 is decremented at 136 if the value is above zero. Also, a check is made at 138 to determine if the system is in a cooldown mode with the flash lamp 96 deactivated under control of the timer 100. If the cooldown mode is not in operation, then the system is returned to the main control loop, but if cooldown is in effect, the cooldown timer 100 is decremented at 140, and if this results in zeroing of the timer, then the cooldown mode is terminated and the system returned to the main control loop.

When the byte is determined not to be a timing byte at 130, then a determination is made at 142 as to whether or not the byte is a stop byte. If a stop byte is not sensed, the program returns to the main control loop.

Continuing with the main control loop, if a data byte is sensed at 116, then an address check is made to determine whether the data byte applies to the specific fixture incorporating the microprocessor 42. This check is made at 144, and if the data byte is for another fixture, the main control loop is again initiated. On the other hand, if it is determined at 144 that the data byte is for the fixture involved, then the data byte is transferred to the hold register 48 at 146.

Turning now to FIG. 7, if a determination is made at 142 that the control byte is a stop byte, then the microprocessor and memory are checked at 148, and if a problem has arisen, the microprocessor is reset at 150. Conversely, if no problem is noted as a result of the check at 148, a determination is made at 150 to insure that the flash lamp assembly is not in the cooldown mode. If the cooldown mode is in effect, then the system returns to the main control loop 112, but if cooldown is not in effect, the system continues operation which will result in firing of the flash lamp 96.

If all control bytes have been received, data bytes have been read at 128, and operation is to continue, then at 152 a maximum intensity is computed from the data packet and at 154 the circuitry of FIGS. 2 and 3 is made operative to provide an intensity level for the flash lamp. If the strobe has been armed at 120, it is permitted to fire at 156, and at 158 the heat value is added to the running total maintained in the register 98. Then at 160, a determination is made as to whether or not the value in the register 98 exceeds a predetermined heat threshold level, and if it does, the system is placed in the cooldown mode at 162. If the heat threshold level has not been exceeded, the program returns to the beginning of the main control loop.

It will be noted that a maximum intensity value was computed at 152. Like the cooldown function, this maximum intensity computation is a novel control function provided by the microprocessor 42 and operates with the cooldown function to protect the flash lamp 96.

A flash lamp can be damaged if it is permitted to flash at maximum intensity at a rate of more than a specific number of flashes per second. As an example, it might be determined that the flash lamp 96 is likely to be damaged if it is permitted to flash at maximum intensity rate greater than ten flashes per second. Using the time base reference or heartbeat pulses from the controller 12, the microprocessor will increment and decrement a maximum intensity control register 164 (FIG. 5) in much the same manner as was done with the cooldown register 98.

If, for example, heartbeat pulses are provided at a rate of 120 pulses per second, and the flash lamp 96 is to be permitted a maximum intensity flash rate of ten flashes per second, then the microprocessor will increment the maximum intensity control register 164 twelve counts for each maximum intensity lamp value received in the data packets from the central controller 12 while decrementing the maximum intensity register one count for each received heartbeat pulse. Obviously, if a maximum intensity flash rate of less than ten flashes per second occurs, no residual value will be created in the maximum intensity register between maximum intensity flashes. However, if the allowable period between maximum intensity flashes is reduced, a residual value will remain in the maximum intensity register when a new maximum intensity flash is ordered, and this residual value is used to access an allowable maximum intensity value stored in the memory 44.

An allowable maximum intensity value which is less than the normal maximum intensity value transmitted by the central controller 12 is stored in the memory 44 for each of a plurality of residual values, and as the residual values increase, the allowable intensity values which they access from memory decrease. An accessed allowable intensity value then becomes the maximum flash intensity value which the microprocessor will permit for the next lamp flash, and this allowable maximum intensity value is sent by the microprocessor to the hold register 48 and digital to analog converter 56 in place of the actual maximum intensity value received from the central controller 12. Thus the flash lamp 96 is not permitted to flash at actual maximum intensity at a rate which is likely to result in damage to the flash lamp.

Industrial Applicability

The microprocessor controlled lamp flashing system of the present invention can be used effectively for many applications, such as stage, theater, night club, and studio lighting as well as for providing special effects lighting for such purposes as sales displays. Each flash lamp fixture includes a microprocessor controller to receive both address and intensity data from a central controller over a serial data link. The microprocessor also provides lamp cooldown in response to calculated heat data based upon the comparison of intensity information with a time reference signal.

We claim:

1. A microprocessor controlled lamp flashing system comprising central controller means operative to provide output data packets, each said data packet including predetermined address signals, time base signals and control and intensity signals, a serial data link connected to said central controller means for transmitting said data packets, and a plurality of light flashing assembly means serially connected to said serial data link to receive said data packets, each said light flashing assembly means including a lamp housing, flash lamp means mounted within said lamp housing for producing light in response to an electrical discharge, lamp control circuit means mounted within said lamp housing and connected to said flash lamp means for producing a controlled electrical discharge to cause said flash lamp means to emit light, AC input means to couple said lamp control circuit means to an AC line voltage source, said lamp control circuit means including a microprocessor means operative to provide cooldown control for said flash lamp means by registering an intensity value for each electrical discharge of said flash lamp means and operating to terminate the provision of said electrical discharge for said flash lamp means when said registered intensity values exceed a predetermined cooldown threshold value and flash control circuit means connected to said microprocessor means for controlling the intensity of said electrical discharge for said flash lamp means, said flash control circuit means operating to generate flash trigger pulses for said flash lamp means at a preselected phase relative to the voltage on said AC line voltage source, said microprocessor means being operative to control said flash control circuit means in response to the time base, control and intensity signals in said data packets and to provide registered intensity signals to said flash control circuit means, said flash control circuit means operating to control the intensity of the light produced by said flash lamp means in response to said intensity signals and an address circuit means connected to said microprocessor means, said address circuit means being operative to preset an address into said microprocessor means, said microprocessor means operating to receive and register intensity signals from a data packet when the address signals in said data packet are indicative of said preset address.

2. The microprocessor controlled light flashing unit of claim 1 wherein said microprocessor means operates to increment a cooldown register means with an intensity value for each electrical discharge for said flash lamp means to maintain a running sum of each new intensity value with any intensity value remaining in said cooldown register means and to decrement said running sum in said cooldown register means with said time base signals.

3. A microprocessor controlled light flashing unit comprising a lamp housing, flash lamp means mounted within said lamp housing for producing light in response to an electrical discharge, lamp control circuit means mounted within said lamp housing and connected to said flash lamp means for producing a controlled electrical discharge to cause said flash lamp means to emit light, and AC input means to couple said lamp control circuit means to an AC line voltage source, said lamp control circuit means including a microprocessor means and flash control circuit means connected to said microprocessor means for controlling the intensity of said electrical discharge for said flash lamp means, said microprocessor means providing cooldown control for said flash lamp means by registering an intensity value for each electrical discharge for said flash lamp means and operating to terminate the provision of said electrical discharge for said flash lamp means when said registered intensity values exceed a predetermined cooldown threshold value.

4. The microprocessor controlled light flashing unit of claim 3 wherein said microprocessor means operates to increment a register means with an intensity value for each electrical discharge for said flash lamp means and to decrement said register means with spaced time base signals.

5. The microprocessor controlled light flashing unit of claim 3 which includes address circuit means connected to said microprocessor means, said address circuit means being operative to preset an address into said microprocessor means, said microprocessor means operating to activate said flash control circuit means to cause said flash lamp means to emit light upon receipt thereby of an address signal indicative of said preset address.

6. The microprocessor controlled light flashing unit of claim 5 wherein said flash control circuit means operates to generate flash trigger pulses at a preselected phase relative to the voltage on said AC line voltage source and to provide said flash trigger pulses to said flash lamp means.

7. A microprocessor controlled lamp flashing system comprising central controller means operative to provide output data packets, each said data packet including predetermined address signals, time base signals and control and intensity signals, a data link connected to said central controller means for transmitting said data packets, and light flashing assembly means connected to said data link to receive said data packets, each said light flashing assembly means including a lamp housing, flash lamp means mounted within said lamp housing for producing light in response to an electrical discharge, lamp control circuit means mounted within said lamp housing and connected to said flash lamp means for producing a controlled electrical discharge to cause said flash lamp means to emit light, and AC input means to couple said lamp control circuit means to an AC line voltage source, said lamp control circuit means including a microprocessor means which provides cooldown control for said flash lamp means by registering an intensity value for each electrical discharge of said flash lamp means and operating to terminate the provision of said electrical discharge for said flash lamp means when said registered intensity values exceed a predetermined cooldown threshold value and flash control circuit means connected to said microprocessor means for controlling the intensity of said electrical discharge for said flash lamp means, said microprocessor means being operative to control said flash control circuit means in response to the time base, control and intensity signals in said data packets.

8. The microprocessor controlled light flashing unit of claim 7 wherein said microprocessor means operates to increment a cooldown register means with an intensity value for each electrical discharge for said flash lamp means to maintain a running sum of each new intensity value with any intensity value remaining in said cooldown register means and to decrement said running sum in said cooldown register means with said time base signals.

9. The microprocessor controlled light flashing unit of claim 8 wherein said microprocessor means operates to terminate said electrical discharge for a predetermined time cooldown period when said cooldown threshold value is exceeded and to reset said cooldown register means at the end of said cooldown period.

10. A microprocessor controlled lamp flashing system comprising central controller means operative to provide output data packets, each said data packet including predetermined address signals, time base signals and control and intensity signals, said intensity signals being indicative of desired light intensities up to a maximum intensity value, a serial data link connected to said central controller means for transmitting said data packets, and a plurality of light flashing assembly means connected to said data link to receive said data packets, each said light flashing assembly means including a lamp housing, flash lamp means mounted within said lamp housing for producing light in response to an electrical discharge, lamp control circuit means mounted within said lamp housing and connected to said flash lamp means for producing a controlled electrical discharge to cause said flash lamp means to emit light of a desired intensity, AC input means to couple said lamp control circuit means to an AC line voltage source, said lamp control circuit means including a microprocessor means operative to provide a maximum intensity control for said flash lamp means by sensing the elapsed time between first and second successive intensity signals indicative of the maximum intensity value and reducing the intensity value indicated by said second intensity signal when said elapsed time is less than a predetermined elapsed time, and flash control circuit means connected to said microprocessor means for controlling the intensity of said electrical discharge for said flash lamp means, said flash control circuit means operating to generate flash trigger pulses for said flash lamp means at a preselected phase relative to the voltage on said AC line voltage source, said microprocessor means being operative to control said flash control circuit means in response to the time base, control and intensity signals in said data packets and to provide registered intensity signals to said flash control circuit means, said flash control circuit means operating to control the intensity of the light produced by said flash lamp means in response to said intensity signals and an address circuit means connected to said microprocessor means, said address circuit means being operative to preset an address into said microprocessor means, said microprocessor means operating to receive and register intensity signals from a data packet when the address signals in said data packet are indicative of said preset address.

11. The microprocessor controlled lamp flashing system of claim 10 wherein said microprocessor means operates upon receipt of an intensity indicative of a maximum intensity to increment a maximum intensity register means with a value equal to the number of time base signals occurring during said predetermined elapsed time and subsequently operates to decrement the value in said maximum intensity register means with said time base signals until the next subsequent intensity signal indicative of a maximum intensity is received thereby.

12. In a microprocessor controlled lamp flashing system having a central controller means operative to provide output data packets which each include predetermined address signals, time base signals and intensity signals indicative of desired light intensities up to a maximum intensity value, a plurality of light flashing assembly to receive said data packets, each said light flashing assembly means including a lamp housing, flash lamp means mounted within said lamp housing for producing light in response to an electrical discharge, and AC power input means for providing an AC power signal to said light flashing assembly means; the invention comprising a serial data link means serially connecting said plurality of light flashing assembly means to said central controller means, said serial data link means operating to provide said data packets to said light flashing assembly means, each said light flashing assembly means including a microprocessor mounted within said lamp housing and connected to receive said data packet from said serial data link means, an address circuit means connected to said microprocessor means, said address circuit means being operative to preset an address into said microprocessor means, said microprocessor means operating to register intensity signals from a data packet when the address signals in said data packet are indicative of said preset address and to provide a register signal, zero crossing detector means to detect the zero crossing of said AC power signal and provide an output zero crossing signal at said zero crossings, and control circuit means connected to said zero crossing detector means and said microprocessor means, said control circuit means operating upon receipt of a register signal and an output zero crossing signal to provide an electrical discharge to said flash signal at a controlled phase relative to the phase of said AC power signal, said microprocessor means operating to control said electrical discharge to control the intensity of the light produced by said flash lamp means in accordance with said intensity signals.

13. A microprocessor controlled light flashing system comprising a source of time base signals and intensity signals indicative of desired light intensities up to a maximum intensity value, a lamp housing, flash lamp means mounted within said lamp housing for producing light in response to an electrical discharge and lamp control circuit means mounted within said lamp housing and connected to said flash lamp means for producing a controlled electrical discharge to cause said flash lamp means to emit light, said lamp control circuit means including a microprocessor means connected to receive said time base and intensity signals and flash control circuit means connected to said microprocessor means for controlling the intensity of said electrical discharge for said flash lamp means, said microprocessor means providing a maximum intensity control for said flash lamp means by sensing the elapsed time between first and second successive intensity signals indicative of a maximum intensity value and reducing the intensity value indicated by said second intensity signal when said elapsed time is less than a predetermined elapsed time.

14. The microprocessor controlled lamp flashing system of claim 13 wherein said microprocessor means operates upon receipt of an intensity signal indicative of a maximum intensity to increment a maximum intensity register means with a value equal to the number of time base signals occurring during said predetermined elapsed time and subsequently operates to decrement the value in said maximum intensity register means with said time base signals until the next subsequent second intensity signal indicative of a maximum intensity is received thereby, said microprocessor means further operating when, upon receipt of said subsequent second intensity signal, an increment remains in said maximum intensity register, to reduce the intensity value indicated by said second subsequent intensity signal.

15. The microprocessor controlled lamp flashing system of claim 13 wherein said microprocessor means operates to provide a cooldown control for said flash lamp means by registering an intensity value for each electrical discharge for said flash lamp means and operating to terminate the provisions of said electrical discharge for said flash lamp means when said registered intensity values exceed a predetermined cooldown threshold value.

16. The microprocessor controlled lamp flashing system of claim 15 wherein said microprocessor means operates to increment a cooldown register means with an intensity value for each electrical discharge for said flash lamp means and to decrement said cooldown register means with said time base signals.

17. The microprocessor controlled lamp flashing system of claim 16 wherein said microprocessor means operates upon receipt of an intensity signal indicative of a maximum intensity to increment a maximum intensity register means with a value equal to the number of time base signals occurring during said predetermined elapsed time and subsequently operates to decrement the value in said maximum intensity register means with said time base signals until the next subsequent intensity signal indicative of a maximum intensity is received thereby.

* * * * *